US006834704B2

(12) United States Patent
Cheng

(10) Patent No.: US 6,834,704 B2
(45) Date of Patent: Dec. 28, 2004

(54) TIGHTLY SHIELDING SCREEN

(76) Inventor: Lung Ching Cheng, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 10/351,090

(22) Filed: Jan. 27, 2003

(65) Prior Publication Data

US 2004/0144504 A1 Jul. 29, 2004

(51) Int. Cl.[7] ..... A47H 19/00
(52) U.S. Cl. ..... 160/349.2
(58) Field of Search ..... 160/330, 349.1, 160/349.2, 126, DIG. 6

(56) References Cited

U.S. PATENT DOCUMENTS 2,303,502 A * 12/1942 Rous ..... 160/349.1
2,608,250 A * 8/1952 Meyer ..... 160/349.1
2,840,160 A * 6/1958 Tichenor ..... 160/349.1
3,282,328 A * 11/1966 Mushro et al. ..... 160/349.1
4,070,735 A * 1/1978 Canaday ..... 160/349.1 X
4,077,072 A * 3/1978 Dezura ..... 160/349.1 X
4,594,741 A * 6/1986 Payne ..... 160/349.1 X
4,887,324 A * 12/1989 Cairns ..... 160/349.2 X
5,148,580 A * 9/1992 Dyckow ..... 160/349.2 X

* cited by examiner

*Primary Examiner*—David Purol

(57) ABSTRACT

A tightly shielding screen is suspended from a rod body so as to be expanded by the rod body; thereby, the screen shielding a space confined by the rod body. At least one joint is arranged between a connection of the screen and the rod body. The joint is formed by a piece body to firmly secured to the screen. A foldable strip parallel to a wall is formed on the piece body. One edge of the foldable strip facing to an edge of the screen is firmly secured to the screen. One side of the foldable strip of the piece body far away from an edge of the screen is a turnable portion so that a connecting unit can be turned along the foldable strip of the piece body facing to the wall to be adhered to the wall. Thereby, the space inside the screen is shielded.

2 Claims, 5 Drawing Sheets

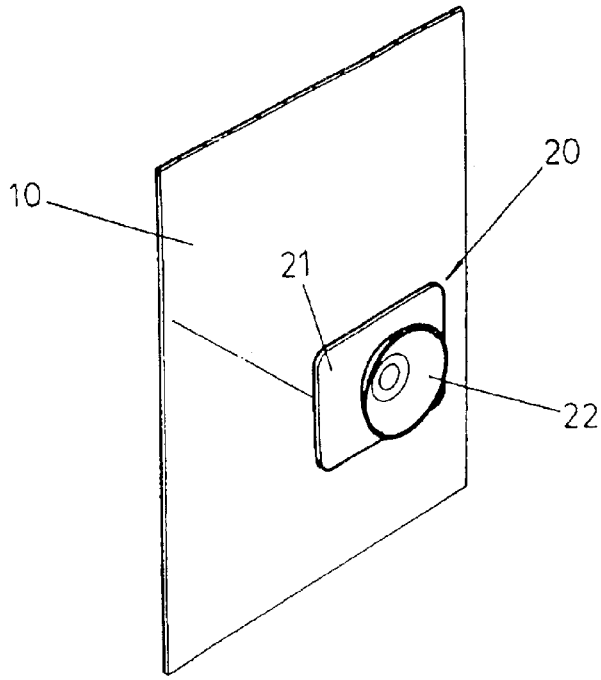
Fig. 4 ( A )
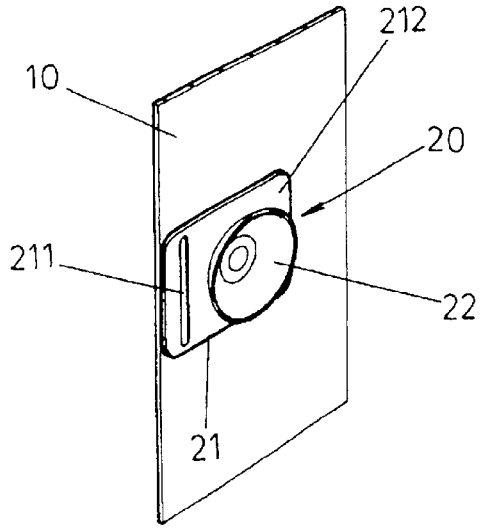
Fig. 4 ( B )

TIGHTLY SHIELDING SCREEN

FIELD OF THE INVENTION

The present invention relates to screens, and particularly to a tightly shielding screen which is especially used in a shower room.

BACKGROUND OF THE INVENTION

Referring to FIG. 1, the screen A is suspended from to a rod body A extending from a wall of a shower room so that the screen A is expanded or folded along the rod body B. The expanding screen A will shield a space confined by the rod body B. Thereby, the screen A can stop the water to drain out of the space confined by the rod body B. In general the screen A is made of Nylon since Nylon is flexible so that it can be operated inconveniently.

However, since above mentioned prior art screen A easily shakes due to wind or shower water or movement of the users. Thereby, the edge of the screen A can not tightly adhere to the wall W so that the function of the screen is affected. Thereby, the shower water may sputter out or drop out to pollute the floor of the whole shower room. As a result, the function of the screen is not achieved.

SUMMARY OF THE INVENTION

Accordingly, the primary object of the present invention is to provide a tightly shielding screen suspended from a rod body so as to be expanded by the rod body, thereby, the screen shielding a space confined by the rod body. At least one joint is arranged between a connection of the screen and the rod body; the joint is formed by a piece body to be firmly secured to the screen. A foldable strip parallel to a wall is formed on the piece body. One edge of the foldable strip facing to an edge of the screen is firmly secured to the screen. One side of the foldable strip of the piece body far away from an edge of the screen is a turnable portion of the connecting means; so that the connecting means can be turned along the foldable strip of the piece body facing to the wall to be adhered to the wall. Thereby, the space inside the screen is shielded.

The various objects and advantages of the present invention will be more readily understood from the following detailed description when read in conjunction with the appended drawing.

BRIEF DESCRIPTION OF THE DRAWINGS

FIGS. 4A and 4B are schematic view showing the connection of the connecting means and the tightly shielding screen according to the present invention.

DETAILED DESCRIPTION OF THE PREFERRED EMBODIMENTS

Figure 3:
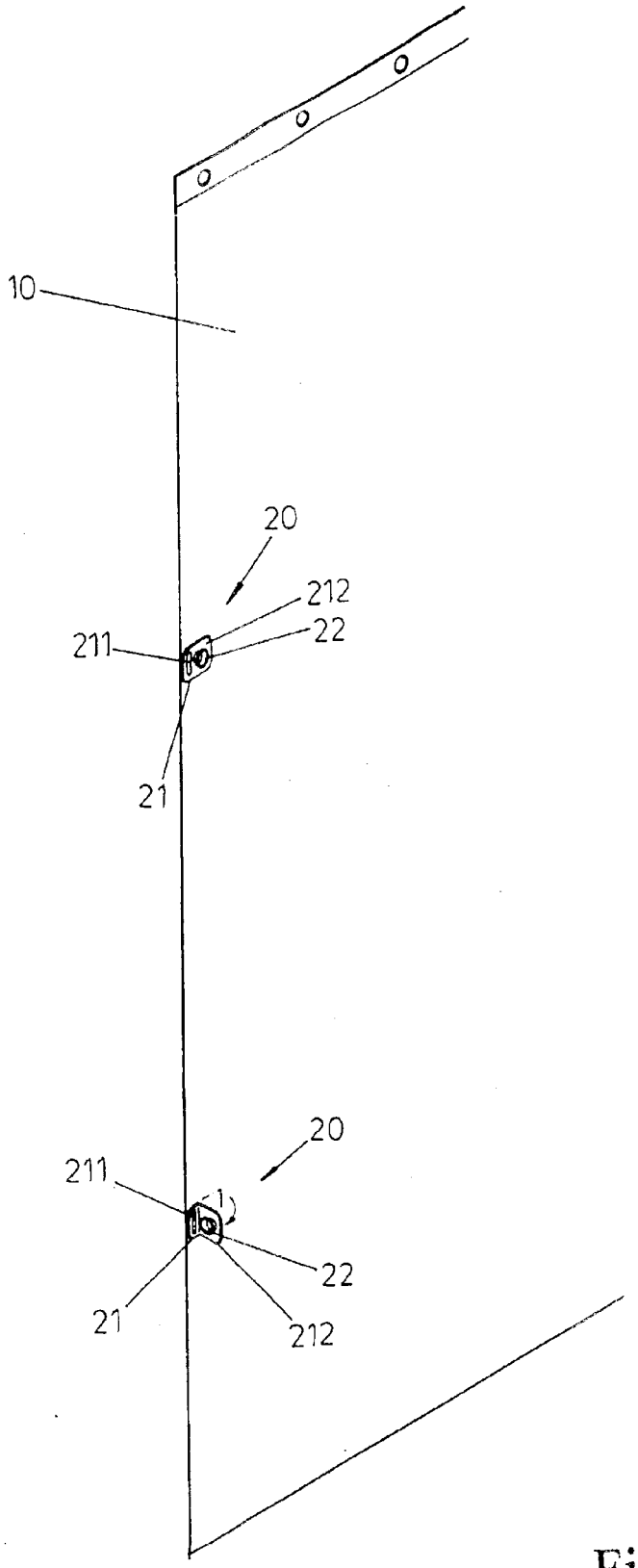
FIG. 3 is an enlarged schematic view showing edges of the screen of the present invention.

Referring to FIG. 3, the screen of the present invention is illustrated. The screen 10 is suspended from a rod body B so as to be expanded by the rod body B. Thereby, the screen 10 will shield a space confined by the rod body B. The screen 10 is made of Nylon plastics to be easily expanded and folded. At least one joint 20 is arranged between the connection of the screen 10 and the rod body B. The joint 20 is formed by a piece body 21 to firmly secured to the screen 10. A foldable strip 211 parallel to the wall W is formed on the piece body 21. One edge of the foldable strip 211 facing to an edge of the screen 10 is firmly secured to the screen 10, as shown in FIGS. 4A and 4B. The piece body 21 of the joint 20 can be made by Nylon plastics as the screen 10. The position of the foldable strip 211 of the piece body 21 is used to connect the piece body 21 to the screen 10 by high frequency welding connection.

Figure 1:
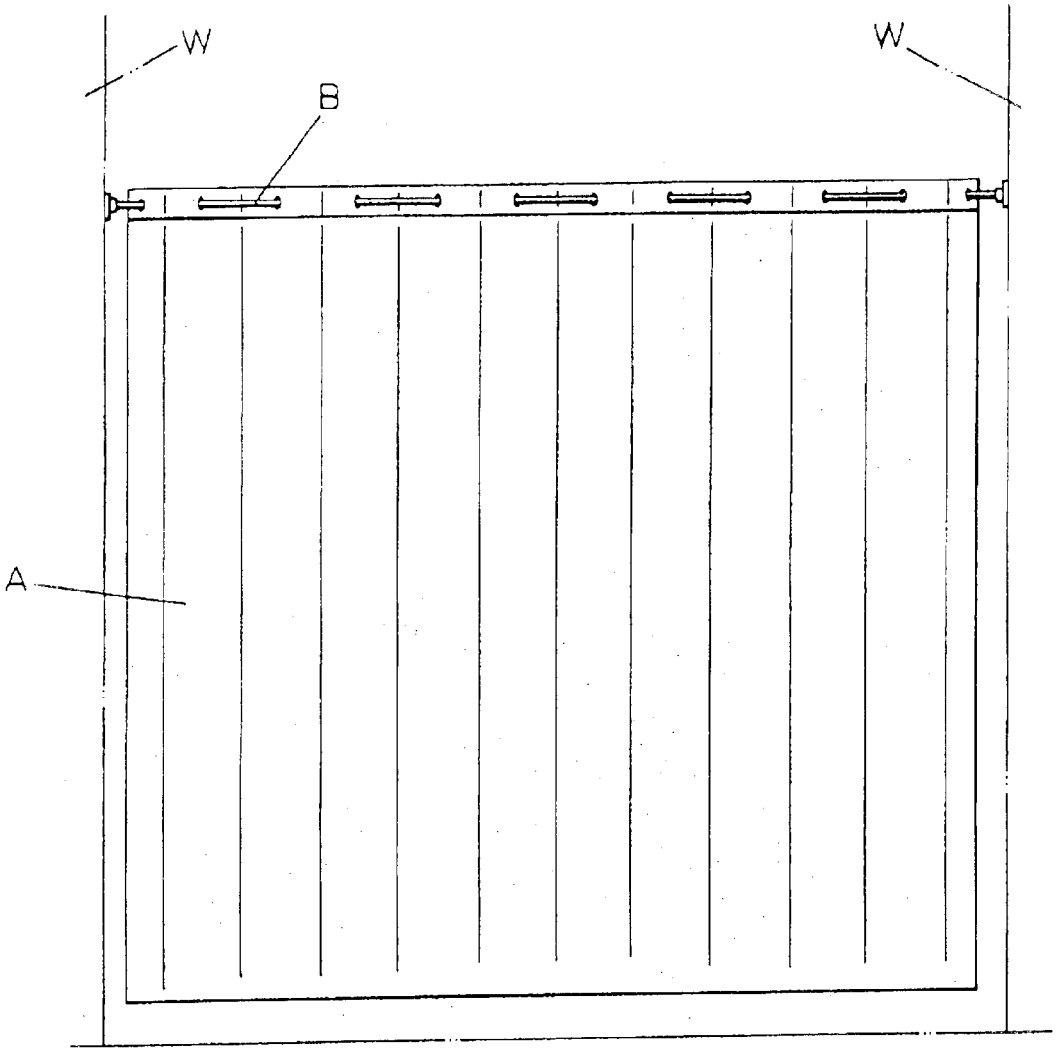
FIG. 1 (PRIOR ART)
FIG. 1 is a structural schematic view of a prior art screen used in a shower room.
Figure 2:
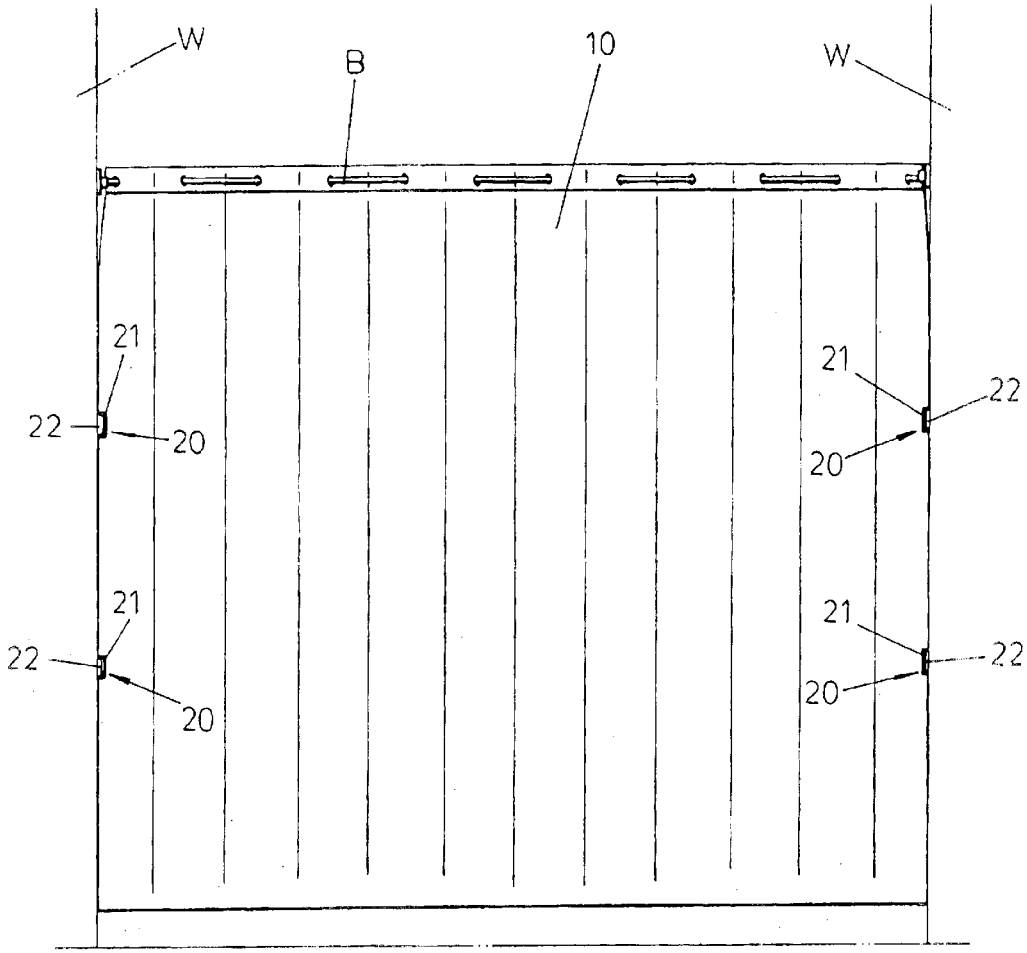
FIG. 2 is a structural schematic view of the screen of the present invention.

One side of the foldable strip 211 of the piece body 21 far away from an edge of the screen 10 is a turnable portion 212 which has a connecting means 22, as shown in FIGS. 2 and 3 so that the connecting means 22 can be turned along the foldable strip 211 of the piece body 21 facing to the wall W to be adhered to the wall W. The foldable strip 211 of the piece body 21 retains to the edge of the screen 10 with a distance equal to the thickness of the connecting means 22. Thereby, when the connecting means 22 is adhered to the wall W, the edge of the screen 10 is exactly flushed with the wall W. Moreover, in the present invention, the connecting means 22 can be formed by a suction disk directly. Thereby, when the screen 10 is expanded, the connecting means 22 can be directly adhered to a smooth wall surface, such as the surface of a tile. The edge of the screen 10 is tightly retained with the wall W so that the screen 10 has a preferred shielding effect.

Figure 5:
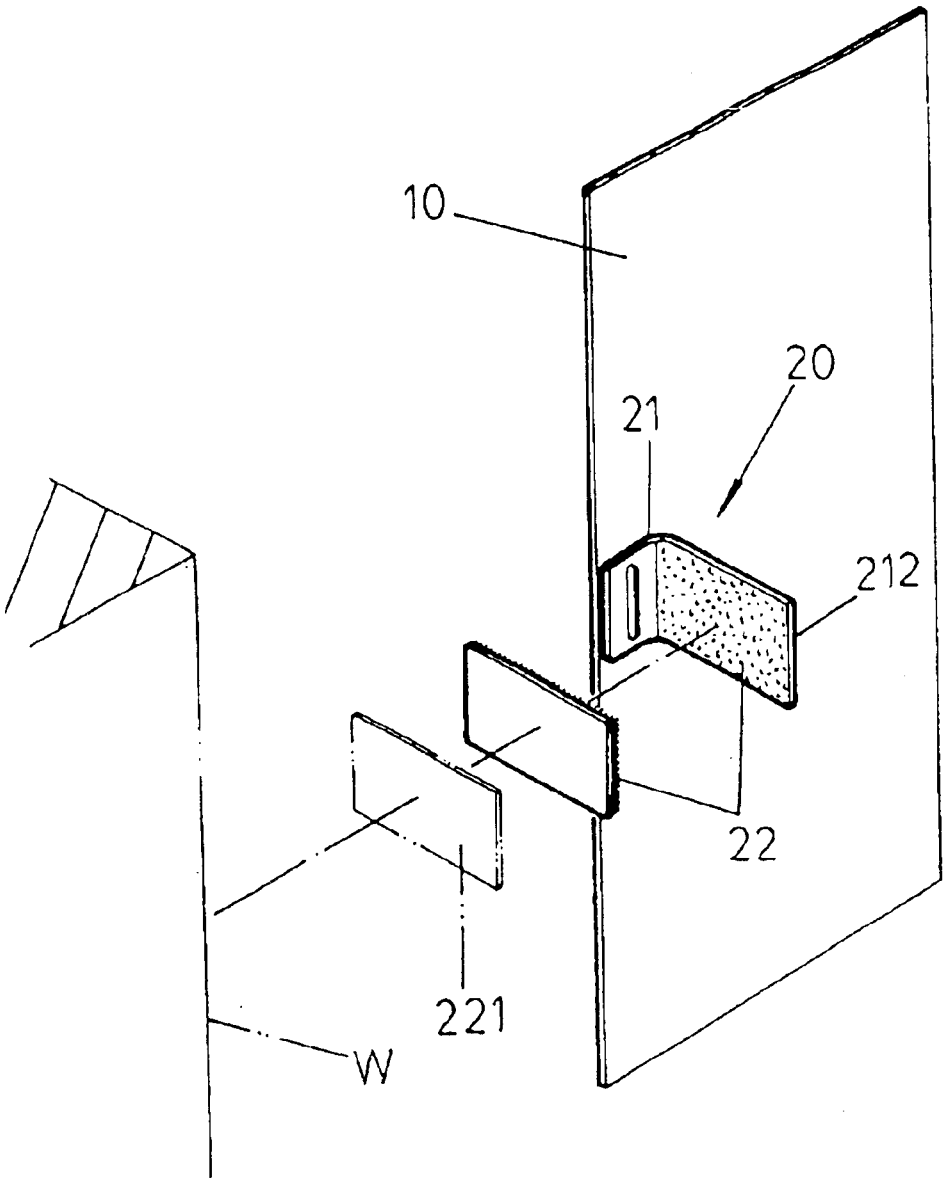
FIG. 5 is a structural exploded view showing another embodiment of the present invention.

Moreover, referring to FIG. 5, sticky strip 20 is adhered to a portion of the turnable portion 212 corresponding to the wall W. The sticky strip is formed as a connecting means 22. The sticky strip forming the connecting means 22 may be double face tapes 221 which are adhered to the screen 10 and the wall W so that the connection of the screen 10 and the rod body B can be performed rapidly. Furthermore, the position of the connecting means 22 can be changed so that the edge of the screen 10 resists against the wall W in an optimum condition.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A shield screen retaining device retaining a shielding screen suspended from a rod body, the device comprising:

at least one joint being arranged between a connection of the screen and a wall; the joint having a piece body for securing the screen to the wall;

a foldable strip parallel to the wall and formed on the piece body; one edge of the foldable strip facing an edge of the screen being firmly secured to the screen; one side of the foldable strip of the piece body distant form the edge of the screen being a turnable portion;

a connecting means on the turnable portion for adhering to the wall and being secured to the foldable strip of the piece body so as to face the wall of which it is to be adhered, thereby shielding the space inside the screen;

wherein the foldable strip of the piece body is positioned with a distance to the edge of the screen, and the distance is equal to the thickness of the connecting means;

wherein the screen and the piece body are made of nylon; the piece body and the screen are connected through the foldable strip by high frequency welding; and wherein the connecting means is a suction disk.

2. A shield screen retaining device retaining a shielding screen suspended form a rod body; the device comprising;

at least one joint being arranged between a connection of the screen and a wall; the joint having a piece body for securing the screen to the wall;

a foldable strip parallel to the wall and formed on the piece body; one edge of the foldable strip facing an edge of the screen being firmly secured to the screen; one side of the foldable strip of the piece body distant form the edge of the screen being a turnable portion;

a connecting means on the turnable portion for adhering to the wall and being secured to the foldable strip of the piece body so as to face the wall of which it is to be adhered, thereby shielding the space inside the screen;

the connecting means is a sticky strip adhered to a portion of the turnable portion; wherein the sticky strip is a double face tape; and wherein the foldable strip of the piece body is positioned with a distance to the edge of the screen, and the distance is equal to the thickness of the connecting means; and wherein the screen and the piece body are made of nylon; the piece body and the screen are connected through the foldable strip by high frequency welding.

* * * * *